United States Patent [19]

Bonfiglioli et al.

[11] Patent Number: 5,058,810

[45] Date of Patent: Oct. 22, 1991

[54] FUEL METERING AND ATOMIZING VALVE FOR AN INTERNAL COMBUSTION ENGINE FUEL SUPPLY DEVICE

[75] Inventors: Silverio Bonfiglioli, Zola Predosa; Francesco Morini, Bologna, both of Italy

[73] Assignee: Weber S.r.l., Turin, Italy

[21] Appl. No.: 629,062

[22] Filed: Dec. 14, 1990

Related U.S. Application Data

[63] Continuation of Ser. No. 370,345, Jun. 22, 1989, abandoned.

[30] Foreign Application Priority Data

Jun. 23, 1988 [IT] Italy ..... 53244/88[U]

[51] Int. Cl.[5] ..... B05B 1/34; F02M 61/16

[52] U.S. Cl. ..... 239/489; 239/533.1; 239/533.12; 239/585; 239/590.5

[58] Field of Search ..... 239/461, 463, 487, 489, 239/491, 493, 533.2-533.12, 590.5, 585

[56] References Cited

U.S. PATENT DOCUMENTS

| | | | |
|---|---|---|---|
| 40,847 | 12/1863 | Martin | 239/461 |
| 2,242,680 | 5/1941 | Schacht | 239/489 |
| 3,472,382 | 10/1969 | Soriente et al. | 239/463 X |
| 4,339,082 | 7/1982 | Radaelli et al. | 239/585 |
| 54,394,973 | 7/1983 | Sauer et al. | 239/585 X |
| 4,427,156 | 1/1984 | Bouthors et al. | 239/585 X |
| 4,483,485 | 11/1984 | Kamiya et al. | 239/585 |
| 4,564,145 | 1/1986 | Takada et al. | 239/533.3 X |
| 4,662,567 | 5/1987 | Knapp | 239/585 |
| 4,711,397 | 12/1987 | Lahiff | 239/585 X |
| 4,732,327 | 3/1988 | Aichele et al. | 239/533.12 X |
| 4,807,812 | 2/1989 | Renowden et al. | 239/585 X |
| 4,971,291 | 11/1990 | Cristiani et al. | 239/585 X |
| 4,986,478 | 1/1991 | Bertini | 239/585 |

FOREIGN PATENT DOCUMENTS

| | | | |
|---|---|---|---|
| 852182 | 8/1952 | Fed. Rep. of Germany | 239/533.3 |
| 261153 | 11/1926 | United Kingdom | 239/533.12 |
| 298257 | 9/1928 | United Kingdom . | |

*Primary Examiner*—Andres Kashnikow
*Assistant Examiner*—William Grant
*Attorney, Agent, or Firm*—Jeffers, Hoffman & Niewyk

[57] ABSTRACT

The present invention is fuel metering and atomizing valve for an internal combustion engine fuel supply device. The valve comprises a nozzle in which is formed an injection hole having an upstream chamber defining gradually decreasing areas towards the mouth of the injection hole for separating the fuel jet. The present invention provides an injection hole that is easy to machine and which effectively separates the fuel jet issuing from the chamber.

10 Claims, 3 Drawing Sheets

FUEL METERING AND ATOMIZING VALVE FOR AN INTERNAL COMBUSTION ENGINE FUEL SUPPLY DEVICE

This is a continuation of application Ser. No. 07/370,345, filed June 22, 1989, now abandoned.

BACKGROUND OF THE INVENTION

The present invention relates to a fuel metering and atomizing valve for an internal combustion engine fuel supply device.

Known valves of the aforementioned type comprise a nozzle in which is formed an injection hole supplying fuel to the engine. The air and fuel mixture may be formed either directly inside the engine cylinders or beforehand in a special mixing chamber. Correct operation of an internal combustion engine is known to depend substantially on the quality of the air-fuel mixture; that is to say, flame propagation or combustion is improved in proportion to how finely the fuel is atomized in the air-fuel mixture. On known fuel atomizing valves, this is provided for in two ways, both of which, however, present drawbacks. The first consists in adding material on to the surface of the injection hole, so as to form projections or grooves for separating the fuel jet. In addition to affecting delivery, which should depend solely on the hole section, this solution also involves complex, high-cost machining. The second consists in varying the diameter of an appendix on a plugging member. In this case, too, however, the size of the appendix is such that the machining involved is both complex and, consequently, expensive.

SUMMARY OF THE INVENTION

The aim of the present invention is to provide a fuel metering and atomizing valve designed to overcome the aforementioned drawbacks, i.e. comprising an injection hole that is both easy to machine and designed in such a manner as to effectively separate the fuel jet. With this aim in view, according to the present invention, there is provided a fuel metering and atomizing valve for an internal combustion engine fuel supply device, characterised by the fact that it comprises a nozzle in which is formed an injection hole having an upstream chamber defining a number of gradually decreasing areas towards the mouth of said injection hole, so as to separate the fuel jet issuing from said chamber when this is released by a plugging member.

BRIEF DESCRIPTION OF THE DRAWINGS

A number of non-limiting embodiments of the present invention will be described by way of examples with reference to the accompanying drawings, in which.

DETAILED DESCRIPTION OF THE INVENTION

Figure 1:
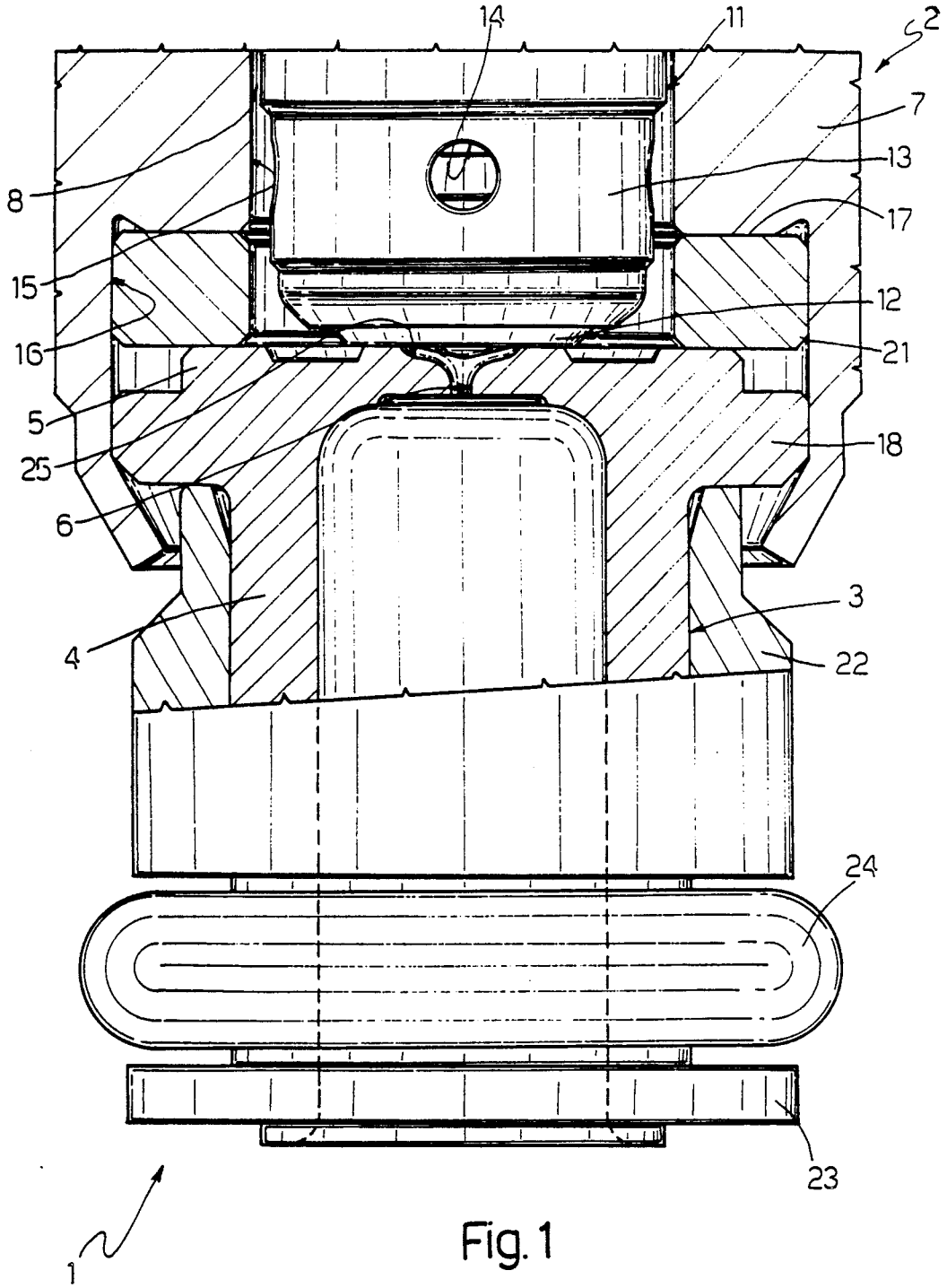
FIG. 1 shows a section of a fuel metering and atomizing valve in accordance with the teachings of the present invention.

Number 1 in FIG. 1 indicates a fuel metering and atomizing valve 1 for a known type of internal combustion engine fuel supply device 2 (shown only partially). Said valve 1 comprises a substantially tubular nozzle 3 having a cylindrical side wall 4 and a top wall 5 in which is formed an injection hole 6. Device 2 comprises a substantially cylindrical body 7 the bottom of which supports nozzle 3 by top wall 5 of the same. Body 7 presents an axial hole 8 inside which a plugging member 11 slides axially; said member 11 presenting a head 12 having a flat face designed, at a given operating stage, to plug the top of injection hole 6.

Fuel preferably flows along an axial hole inside plugging member 11 to a bottom end portion 13 and through radial holes 14 into an annular chamber 15 defined inside hole 8 about said portion 13 and head 12. Plugging member 11 is drawn upwards by electromagnetic actuator E, against the action of spring means, by the magnetic force exerted by an electromagnetic control which includes a ferromagnetic core, energized by an electric coil, on an anchor integral with plugging member 11 wherein actuator E includes the spring means and the electromagnetic control.

As shown in FIG. 1, the bottom end of hole 8 presents a larger-diameter portion 16 defining an inner shoulder 17 and housing the top portion of nozzle 3. In particular, the bottom edge of body 7 is turned inwards of said portion 16 so as to grip an annular flange 18 formed on top wall 5 of nozzle 3. Between said wall 5 and shoulder 17, there is fitted an annular spacer 21. In actual use, device 2 is supported on a body having a seal inside which the bottom of nozzle 3 is fitted. For this purpose, nozzle 3 is fitted with a tubular coupling 22 which, together with a retaining ring 23 on the bottom end of nozzle 3, defines a bottom annular seat for an annular seal 24 sealing the connecting seat of nozzle 3. Injection hole 6 is formed in wall 5 along the longitudinal axis of nozzle 3, and presents a substantially truncated-cone-shaped top chamber 25 tapering downwards and blending with hole 6. Material is removed off the inner face of wall 5 at the mouth of hole 6.

The amount of fuel supplied depends on the section of hole 6, which remains substantially constant, whereas the atomizing function is performed inside chamber 25, which is specially designed to effectively separate the fuel jet. For this purpose, the surface of chamber 25 presents areas defined by ribs or grooves for separating the fuel jet, and decreasing gradually towards the mouth of hole 6.

Figure 2:
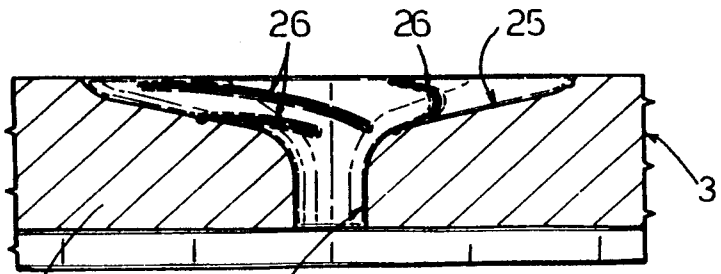
FIGS. 2 and 3 show a larger-scale section and plan view respectively of a first embodiment of the injection hole on the FIG. 1 valve.
Figure 3:
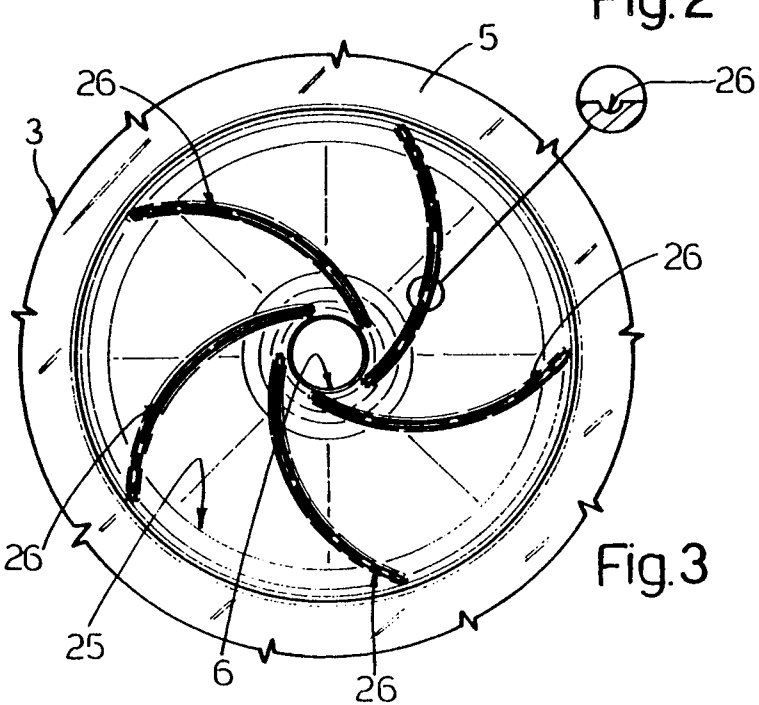

In FIGS. 2 and 3, said areas are defined by ribs 26 which, viewed from above, present a curved longitudinal axis, in this case, in the form of an arc of a circle. In the embodiment shown, the surface of chamber 25 presents five equally-spaced ribs 26 substantially tangent or parallel at the bottom to straight lines tangent to hole 6.

Figure 4:
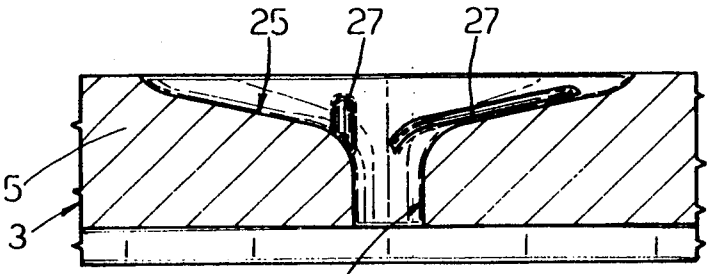
FIGS. 4 and 5 show a larger-scale section and plan view respectively of a second embodiment of the injection hole on the FIG. 1 valve.
Figure 5:
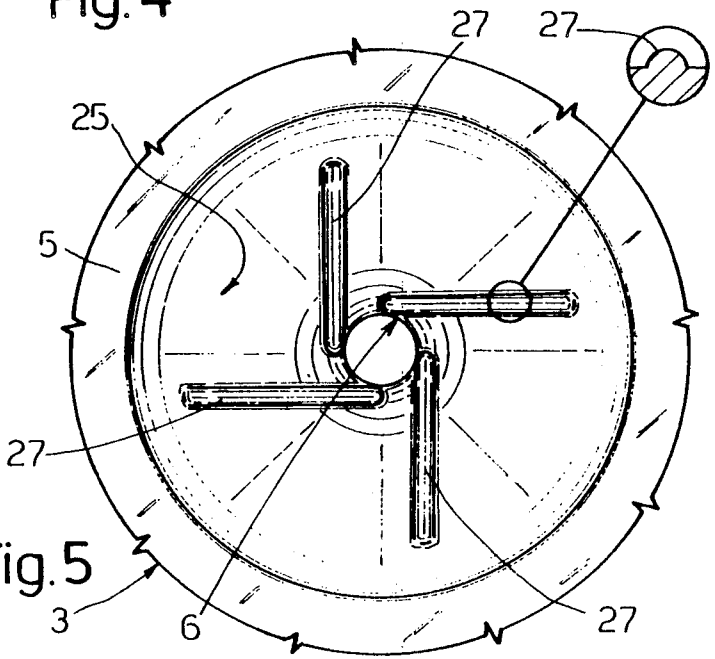

In FIGS. 4 and 5, said areas are defined by straght ribs 27 which, viewed from above, also present a longitudinal axis substantially tangent to the edge of hole 6. In the embodiment shown, the surface of chamber 25 presents four equally-spaced ribs 27, each perpendicular to the adjacent two ribs.

Figure 6:
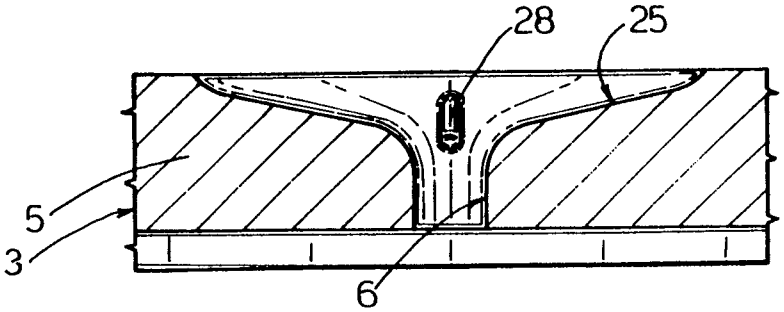
FIGS. 6 and 7 show a larger-scale section and plan view respectively of a third embodiment of the injection hole on the FIG. 1 valve.
Figure 7:
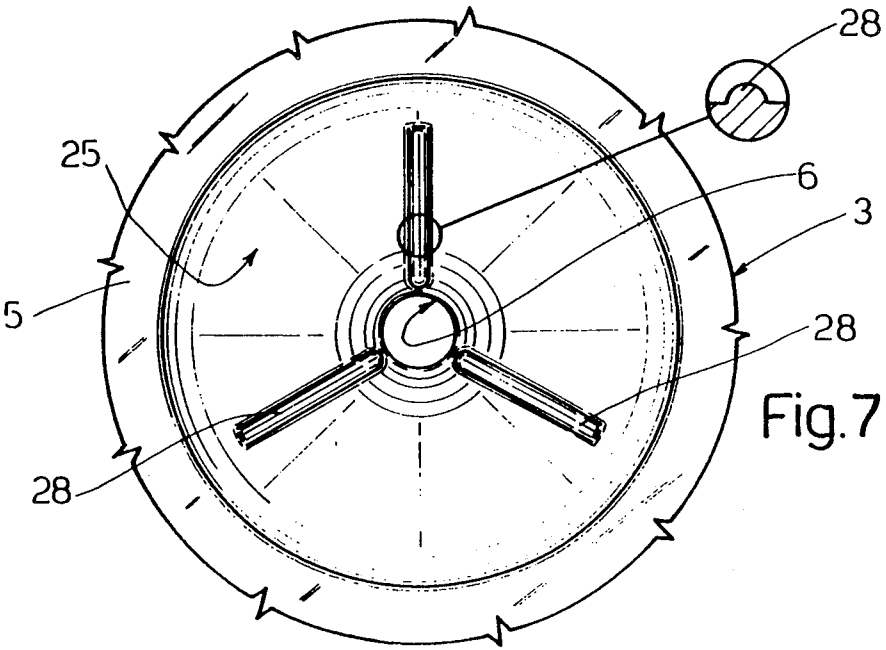

In FIGS. 6 and 7, said areas are defined by straight ribs 28 which, viewed from above, converge with the axis of hole 6. In the embodiment shown, chamber 25 presents three ribs 28 spaced 120° apart. As already stated, the formation on the surface of chamber 25 of gradually decreasing areas towards the mouth of hole 6 provides for separating and, consequently, atomizing the fuel jet. Moreover, in the embodiments shown in FIGS. 2 to 5, said areas come out inside hole 6 substantially tangent to the same, thus imparting tangential velocity on the fuel jet for further improving atomization of the same.

Valve 1 is manufactured as follows.

Firstly, nozzle 3 is formed, preferably by turning, after which, a hole is formed in wall 5 similar to the final configuration of hole 6 and chamber 25. Lastly, the design of chamber 25 (ribs 26, 27 or 28) and the final diameter of hole 6 are formed by coining.

The advantages of the present invention will be clear from the foregoing description.

In particular, it provides for a nozzle in which the fuel jet is separated upstream from the injection hole, the diameter of which remains unchanged, thus maintaining a constant fuel supply. The fuel jet is separated by simply forming on the surface of chamber 25 a number of gradually decreasing areas defined by grooves or ribs. Moreover, said chamber 25 may be designed to impart tangential velocity on the fuel jet for further improving atomization of the same. Lastly, the configuration of hole 6 and the surface of chamber 25 is formed by means of a straightforward coining operation, which, in addition to being low-cost, is far more accurate than operations involving added material or removal.

Locating chamber 25 upstream from hole 6 obviously means altering the plugging member, or rather the part of the same cutting off fuel supply to the nozzle. This consists in forming, on the end of the plugging member, a head having a flat face designed to press against the upper face of wall 5 over chamber 25. Manufacture of the plugging member is thus simplified considerably by virtue of the plugging function being performed by a straightforward flat face on the head of the plugging member.

To those skilled in the art it will be clear that changes may be made to valve 1 as described and illustrated herein without, however, departing from the scope of the present invention.

For example, the surface of chamber 25 may present gradually decreasing areas towards the mouth of hole 6 defined by grooves or ribs having a different configuration from those described and illustrated herein.

We claim:

1. A fuel metering and atomizing valve for an internal combustion engine fuel supply device, comprising a plugging member and a nozzle including an injection hole and an upstream chamber with an interior having an interior surface said plugging member spaced away from said interior wherein said chamber is substantially in the form of a truncated cone having a narrower end, said injection hole being substantially constant in cross-sectional area and defining a mouth, said interior surface including ribs, said chamber gradually decreasing in cross-sectional area towards said mouth of said injection hole, wherein said narrower end abuts said injection hole substantially tangent to said injection hole, said ribs being substantially tangent to the outer circumference of said mouth so as to impart a tangential velocity on and separate a fuel jet issuing from said chamber when said fuel jet is released by said plugging member.

2. The valve as claimed in claim 1 wherein said ribs are equally spaced over said surface defining said chamber.

3. The valve as claimed in claim 1 wherein said ribs are substantially straight in a plan view.

4. The valve as claimed in claim 1 wherein said ribs are four in number and in a plan view each rib is arranged perpendicular to the adjacent two ribs.

5. The valve as claimed in claim 1 wherein said ribs have a shape in a plan view with the form of an arc of a circle.

6. The valve as claimed in claim 1 wherein said chamber is formed by coining said surface.

7. The valve as claimed in claim 6 wherein the diameter of said injection hole is formed by coining a hole formed in said nozzle.

8. A fuel metering and atomizing valve for an internal combustion engine fuel supply device, comprising a plugging member and a nozzle including an injection hole and an upstream chamber with an interior having an interior surface, said plugging member spaced away from said interior said injection hole being substantially constant in cross-sectional area and defining a mouth, said interior surface including ribs, wherein said ribs are substantially straight in a plan view, said chamber gradually decreasing in cross-sectional area towards said mouth of said injection hole, said ribs being three in number, spaced 120° apart, and define a center line intersecting the axis of said hole, so as to separate a fuel jet issuing from said chamber when said fuel jet is released by said plugging member.

9. A fuel metering and atomizing valve for an internal combustion engine fuel supply device, comprising a plugging member and a nozzle including an injection hole and an upstream chamber with an interior surface, said injection hole being substantially constant in cross-sectional area and defining a mouth, said interior surface including ribs, said chamber gradually decreasing in cross-sectional area towards said mouth of said injection hole, said nozzle being tubular and including a substantially cylindrical side wall and a top wall coaxial with said chamber and said injection hole;

said nozzle including an annular flange and housed inside an end portion of an axial hole formed along a body supporting said nozzle; said body including, at said end portion, a turned-in edge designed to grip said flange; said plugging member adapted to slide along said axial hole against action of a spring means and by virtue of an electromagnetic control member, said plugging member including a head having a flat face adapted, at a given operating stage, to press against an outer face of said top wall over said chamber.

10. The valve as claimed in claim 9 wherein said outer surface of said side wall of said nozzle supports means enabling airtight fitment inside a seat formed in a second supporting body.

* * * * *